US005286137A

United States Patent [19]

Cicinnati et al.

[11] Patent Number: 5,286,137

[45] Date of Patent: Feb. 15, 1994

[54] GUARDRAIL BARRIER

[75] Inventors: Luigi Cicinnati, Padova; Adriano Fracasso, Fiesso D'Artico, both of Italy

[73] Assignee: Metalmeccanica Fracasso S.p.A., Italy

[21] Appl. No.: 972,918

[22] Filed: Nov. 6, 1992

[30] Foreign Application Priority Data

Nov. 22, 1991 [IT] Italy ..... GE91 A000154

[51] Int. Cl.[5] ..... E01F 15/00

[52] U.S. Cl. ..... 404/6; 256/13.1; 256/19

[58] Field of Search ..... 404/17, 22; 428/174, 428/176, 181, 182, 183, 184

[56] References Cited

U.S. PATENT DOCUMENTS

| | | | |
|---|---|---|---|
| 1,517,633 | 12/1924 | Junkers | 428/185 |
| 2,139,138 | 12/1938 | Spafford | 428/184 |
| 3,981,486 | 9/1976 | Baumann | 256/13.1 |
| 4,190,376 | 2/1980 | Urlberger | 403/14 |
| 5,044,609 | 9/1991 | Cicinnati et al. | 256/13.1 |
| 5,139,838 | 8/1992 | Baum | 428/72 |

FOREIGN PATENT DOCUMENTS 2642475 4/1977 Fed. Rep. of Germany .

1584411 12/1969 France .

*Primary Examiner*—William P. Neuder
*Assistant Examiner*—Pamela O'Connor
*Attorney, Agent, or Firm*—Larson and Taylor

[57] ABSTRACT

A metallic guardrail barrier of the type comprising a sustaining post (1), a spacing member (2) extending parallel to the ground, secured at one side to the said sustaining post and carrying at the other side the rail (N), said spacing member being in the form of a substantially flat vertical plate (102) presenting a front portion (502) and a rear portion, in which the said spacing member (2) is connected to said sustaining post (1) by its rear portion so as to be swingable about a fulcrum (7) under the control of a shock absorbing means including a weakened region (9) on said rear portion of the spacing member at a location above and spaced from said fulcrum (7) and a pin (8) which connects said spacing member (2) and said sustaining post (1), and passes through said weakened portion (9), such that said pin (8) causes a tearing of said weakened region (9) when said rail (N) is impacted by a vehicle and said spacing member (2) moves about said fulcrum (7). The spacing member (2) presents at its front portion (502) a weakened region (4, 5) progressively increasing from the top to the bottom of the said front portion.

9 Claims, 2 Drawing Sheets

GUARDRAIL BARRIER

Figure 1:
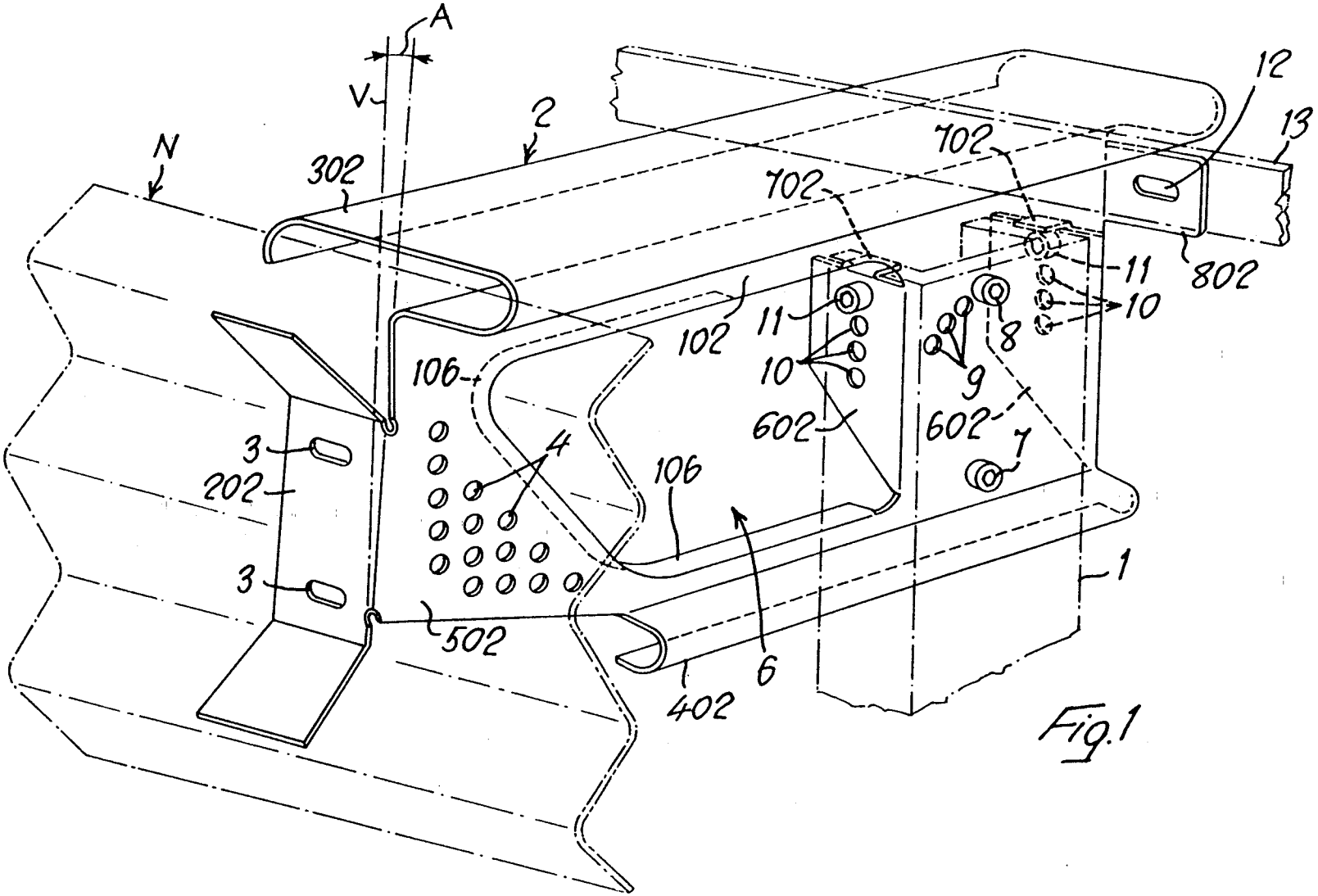

The invention relates to a device for supporting metallic road guardrails, which following to the impact of a vehicle against the rail, dissipates energy with differentiated reactions and which promotes the displacement of the rail of the guardrail barrier in its correct position for restraining and stopping the colliding vehicle.

Document EP-A-0 356 686 (corresponding to U.S. Pat. No. 5,044,609) discloses a metallic guardrail barrier of the type comprising a sustaining post, a spacing member extending parallel to the ground, secured at one side to the said sustaining post and carrying at the other side a supporting member to which the rail is secured, the said supporting member being mounted on the said spacing member so as to be swingable about a fulcrum parallel to the longitudinal direction of the rail and located at a level not coinciding with the level of the centerline of the rail, shock absorbing means being provided to dampen the swinging movement of the supporting member around the fulcrum, following to impact of a vehicle against the rail, in a manner which is proportional to the intensity of the said impact. The said shock absorbing means comprises a pin which connects the said supporting member to the said spacing member at a distance from the said fulcrum and which is arranged to tear a region weakened by holes, which is located on said supporting member or on said spacing member. The supporting member for the rail includes a front wall for securing said rail and a side member having a downwardly diverging shape, said side member having an upper portion in which said fulcrum is located and a lower portion. The said spacing member includes a flat wing which is cantilever mounted to said sustaining post at one side and at another side is connected to said upper portion of the side member by said fulcrum and to said lower portion of the side member by the said pin, and said weakened region has a curved outline having a centerpoint at said fulcrum, said holes being spaced from one another and arranged in a curved row along said weakened region, with said pin passing through one of said holes at an end of said row. The guardrail barrier of the type disclosed further is characterized by the feature that the said spacing member is connected to said sustaining post so as to be swingable about a second lower fulcrum under the control of a second shock absorbing means, said second shock absorbing means including a second weakened region on said spacing member at a location spaced from said second fulcrum and a second pin which connects said spacing member and said sustaining post, and passes through said second weaked portion, such that said second pin causes a tearing of said second weakened region when said rail is impacted by a vehicle and said spacing member moves about said second fulcrum.

The invention aims to simplify the construction and erection in site of the supporting members for road barriers of the type specified above, by eliminating the support which connected the barrier rail to the spacing element. The front portion of the spacing member, prearranged for connection to the rail, is constructed and provided with pre-calculated calibrated weakened regions whereby, upon a crash, said portion is distorted to an extent which increases from the top downwards so as to cause an outward displacement of the lower edge of the rail through a rotation about an imaginary axis parallel to the longitudinal axis of said rail.

Thanks to the present improvements, the road barrier rail is connected to the sustaining post with the intermediary of only one element, i.e. the spacing element, and no longer of two elements, i.e. the spacing element and swingable support, as occurring in the previous solution. Therefore, the practical and economical advantages of the present improvement are evident.

A further improvement is ensured by the connection of the spacing element to the sustaining post, with the intermediary of energy-absorbing systems which are operative also when the spacing member tends to be raised and disconnected from the sustaining post due to crashes of considerable intensity.

Figure 2:
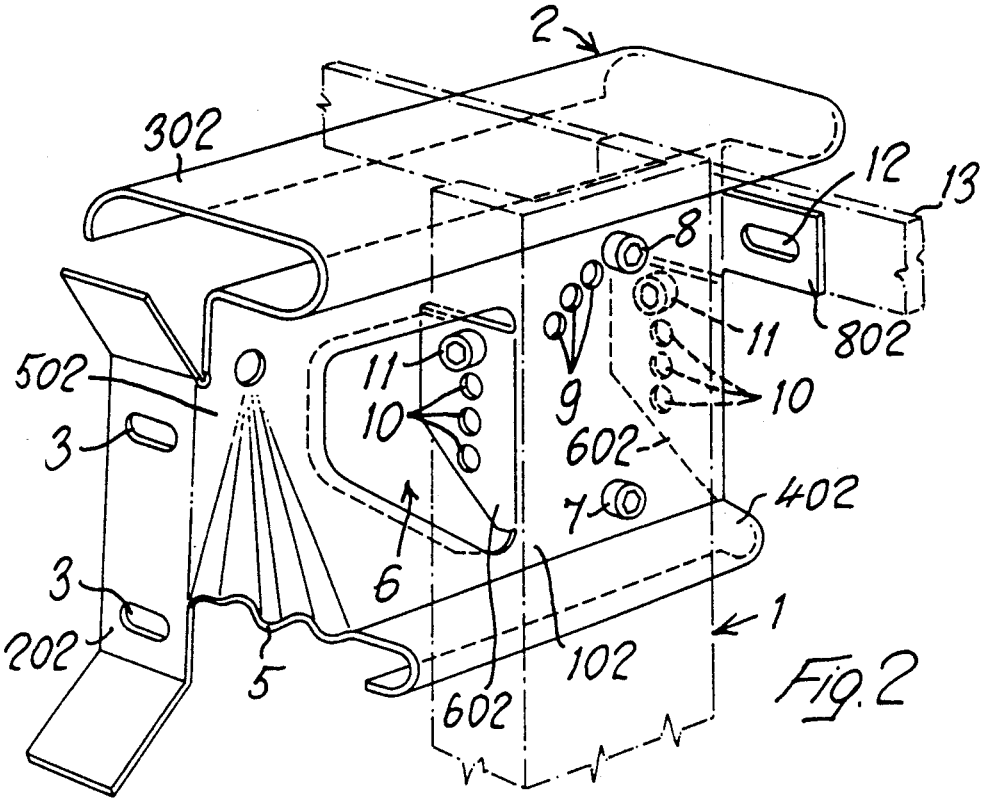
Figure 3:
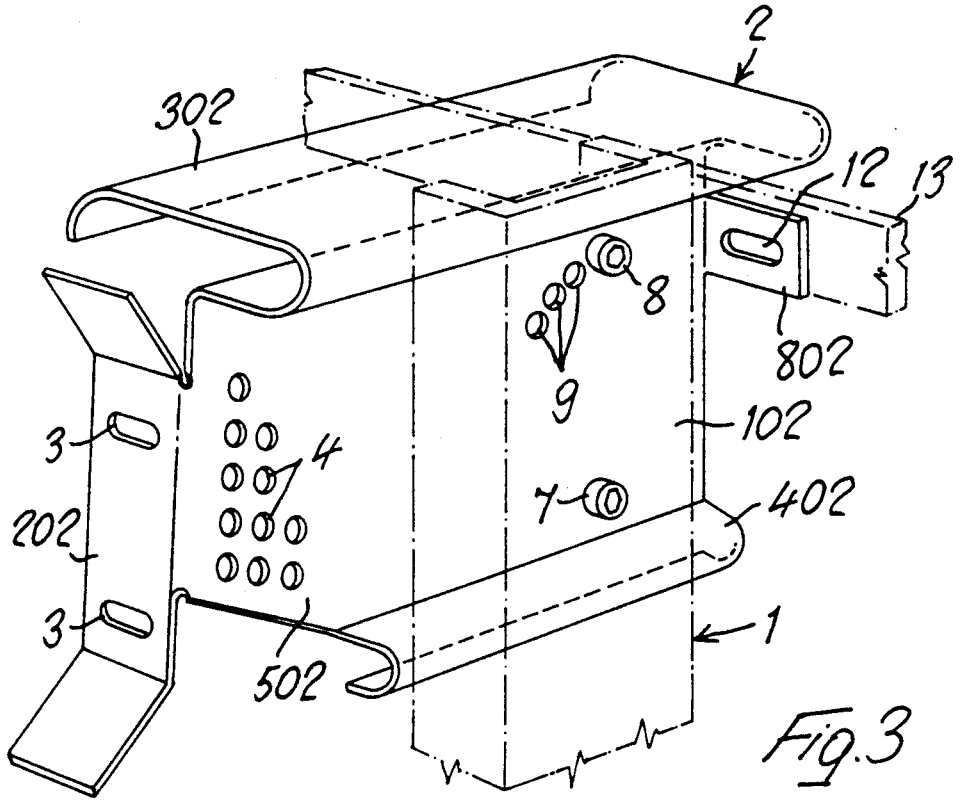

Further features of the invention and the advantages resulting therefrom will become more apparent from the following description of some preferred embodiments shown in the figures of the accompanying drawings, in which:

FIGS. 1, 2 and 3 are perspective views of as many different embodiments of the device according to the invention.

With reference first to FIG. 1, it can be seen that the guardrail barrier N is secured to the sustaining post 1 with the intermediary of a single spacing element 2 obtained by shearing/bending operations and/or possible other operations, from a plate sheet of suitable characteristics and suitable thickness. The flat body portion 102 of the spacing element 2 is provided with a front U-shaped attachment element 202 with divergent wings, the concave portion of which is facing the road and the bottom of which comprises slots or holes 3 for securing the rail N to this component. The attachment element 202 preferably is inclined as shown at A, for example, of 2–4 degrees, with respect to the vertical line V, whereby the rail N will be inclined transversely.

The upper and lower sides of the spacing element 2 are C-shaped as indicated at 302 and 402, respectively, so as to form longitudinal strengthening ribs. The rear ends of these ribs are on the same imaginary vertical plane, whereas the front end of the lower rib 402 is suitably displaced rearwards from the portion 202, so that the latter will be connected to said ribs through a flat portion 502 of the body portion 102, having a substantially triangular shape and an increasing extent from the top downwards. This portion 502 may be provided with suitably distributed holes 4, or with corrugations 5 in parallel or fanwise relation as indicated in FIG. 2, or other weakened areas whereby, upon a collision of a motor-vehicle against the barrier guardrail N, said portion 502 will be bent towards the sustaining post 1, with a displacement increasing from the top downwards so as to permit the portion 202 and the rail N to rotate about an axis which is parallel to the longitudinal axis of said rail N and which is close to the upper rib 302 of the spacing element.

The body portion 102 of the spacing element 2, in the region between the collapsible portion 502 and the side connected to the post 1, may be provided with a window 6 which is framed, if desired, by stiffening rims 106 protruding, for example, from the side whereby said spacing member is connected to the post 1. The window 6, for example, is of quadrilateral shape and, upon a very strong crash, it permits the spacing element to be bent with an oscillation upwards about imaginary fulcrums located at the rear corner regions of said window 6, i.e. close to the post 1.

The rear portion of the body portion 102 is secured to the post 1 by means of a pair of bolts or other suitable means 7 and 8 arranged above each other and suitably spaced apart. Forwardly of the upper bolt 8, in the region directed towards the barrier guardrail, the body portion 102 of the spacing element is provided with a plurality of holes or other weakening means 9 arranged on an imaginary circumference the center of which is at the lower bolt 7. This type of connection of the spacing element to the post constitutes, in case of a crash, a further energy-recovering and dissipating system, because said spacing element tends to rotate upwards with fulcrum at the lower bolt 7 and with rupture at its portion which is weakened by the holes 9. This rotation, which can be pre-calculated, and the previously-discussed one which is caused by the deformation of the spacing element due to the presence of the window 6, result in a proportional raising of the barrier guardrail, which can thus effectively restrain the colliding vehicle and prevent it from jumping over the rail.

In combination with, or alternatively to, the solution described above, the spacing element 2 may be connected to opposite parallel faces of the post 1 by means of either one or two parallel lugs 602 which are formed integrally with the body portion 102 of said spacing member, the inner lug being constituted either completely or partly from the material resulting from the formation of the weakening window 6 discussed above (FIGS. 1 and 2). The lugs 602 may be provided with a plurality of holes 10 aligned in vertical rows and, at the upper one of said holes, said lugs are secured to the post 1 by means of bolts 11 or equivalent means. In case of a particularly strong crash, the portions 10 and 11 will also constitute an energy-dissipating system becoming operative when the spacing member is urged upwards, until a complete disconnection from the post 1 is reached.

In order to facilitate a correct connection of the spacing element to the post 1, said lugs 602 are provided at their top with preferably integral projections 702 which are bent towards each other and adapted to abut against the top side of the post.

Integrally formed on the top rear end of the body portion 102 of the spacing member there is a lug 802 with a slot 12 for connection to a beam 13 arranged on the outer side of the post 1 and which interconnects all the spacing elements 2 supporting the barrier guardrail.

We claim:

1. A metallic guardrail barrier of the type comprising a sustaining post, a one piece spacing member extending parallel to the ground, secured at one side to the said sustaining post and carrying at the other side the rail, said spacing member being in the form of a substantially flat vertical plate presenting a front portion and a rear potion, in which the said spacing member is connected to said sustaining post by its rear portion so as to be swingable about a fulcrum under the control of a shock absorbing means including a weakened region on said rear portion of the spacing member at a location above and spaced from said fulcrum and a pin and said sustaining post, and passes through said weakened portion, such that said pin causes a tearing of said weakened region when said rail is impacted by a vehicle and said spacing member moves about said fulcrum, the spacing member presenting at its front portion a weakened region progressively increasing from the top to the bottom of the said front portion, wherein said weakened region defines a portion of said one piece spacing member.

2. A guardrail barrier according to claim 1 wherein the weakened region in the front portion of the spacing member is obtained by through bores arranged grossly according to a triangular pattern.

3. A guardrail barrier according to claim 1 wherein the weakened region in the front portion of the spacing member is obtained by corrugations arranged fanwise grossly according to a triangular pattern.

4. A guardrail barrier according to claim 1, wherein the spacing element presents, at the front side of its flat body portion, an attachment for securing and supporting the rail, said spacing element being formed at its upper and lower sides with longitudinal folds constituting stiffening ribs, the front end of the lower rib being arranged rearwards with respect to the imaginary vertical plane containing the corresponding front end of the upper rib, so that the portion of the spacing element interposed between the front ends of said ribs and said attachment will have a substantially triangular configuration.

5. A guardrail barrier according to claim 4, wherein the flat body portion of the spacing member is provided at an intermediate position with at least one weakening window which upon a crash permits the spacing element to be bent upwards and to proportionally raise the barrier guardrail.

6. A guardrail barrier according to claim 5, wherein the spacing member is arranged laterally of the sustaining post and is secured to the front and rear faces of the said post by means of a pair of parallel lugs formed integrally with the body portion of said spacing member, the lug which is nearer to the guardrail being formed at least partially by the material resulting from the formation of the said weakening window.

7. A guardrail barrier according to claim 6, wherein bolts are provided for securing the of the spacing member to the sustaining post (1), and said lugs present, below the said bolts, vertical rows of weakening holes.

8. A guardrail barrier according to claim 6, wherein said lugs, are provided at the top with projections which are bent inwards and which rest on the top end of said post, so as to facilitate the correct positioning of the spacing member on said post.

9. A guardrail barrier according to claim 1, wherein the spacing member is provided at its rear side with an integral lug having a hole or slotted opening for connection to a beam which interconnects the various spacing members which are sequentially secured to the barrier guardrail.

* * * * *